US009302748B2

(12) United States Patent
Ingebretsen et al.

(10) Patent No.: US 9,302,748 B2
(45) Date of Patent: Apr. 5, 2016

(54) DECK ARRANGEMENT ON A VESSEL OR PLATFORM FOR PERFORMING SUBSEA OPERATIONS

(75) Inventors: Geir Ingebretsen, Kristiansand (NO); Knut Halvorsen, Lillesand (NO)

(73) Assignee: Aker MH AS, Kristiansand (NO)

( * ) Notice: Subject to any disclaimer, the term of this patent is extended or adjusted under 35 U.S.C. 154(b) by 94 days.

(21) Appl. No.: 14/124,564

(22) PCT Filed: Jun. 8, 2012

(86) PCT No.: PCT/EP2012/060891

§ 371 (c)(1),
(2), (4) Date: Jan. 28, 2014

(87) PCT Pub. No.: WO2012/168428

PCT Pub. Date: Dec. 13, 2012

(65) Prior Publication Data

US 2014/0137784 A1 May 22, 2014

(30) Foreign Application Priority Data

Jun. 9, 2011 (NO) ..... 20110840

(51) Int. Cl.
*B63B 35/44* (2006.01)

(52) U.S. Cl.
CPC ..... *B63B 35/4413* (2013.01)

(58) Field of Classification Search
CPC .. B63B 35/44; B63B 35/4413; F05B 2240/95
USPC ..... 114/264, 265, 266, 267
See application file for complete search history.

(56) References Cited

U.S. PATENT DOCUMENTS

| | | | | |
|---|---|---|---|---|
| 4,063,650 | A | 12/1977 | Homer | |
| 6,761,124 | B1 | 7/2004 | Srinivasan | |
| 2009/0151955 | A1 | 6/2009 | Bamford et al. | |
| 2011/0036287 | A1* | 2/2011 | Wijning | B63B 35/4413 114/74 R |

OTHER PUBLICATIONS

Gaddy et al., "Jack Ryan Drillship to use retractable thrusters, MUX control systems," Oil and Gas Journal, Nov. 27, 2000, vol. 98, No. 48, pp. 38-42.

* cited by examiner

*Primary Examiner* — Anthony Wiest
(74) *Attorney, Agent, or Firm* — Birch, Stewart, Kolasch & Birch, LLP

(57) ABSTRACT

A deck arrangement for a vessel or platform (1) configured for performing subsea operations, the vessel or platform having a main deck (2) and a working station (4*a*) and facilities (9*b*, 6; 28) for supporting activities in the working station, the working station further comprising a working area (4*b*). One or more deck elements (14*a,b*, 15) are arranged at an elevation different from than of the main deck (2) and at an elevation where upper surfaces of the deck elements (14*a,b*, 15) and the upper surface of the working area (4*b*) are on the same, or substantially same, level. Preferably, the deck elements are arranged above the main deck (2) and above one or more of the facilities (9*b*, 6, 28). The facilities may be a riser storage compartment, a BOP area and/or a pipe deck.

16 Claims, 5 Drawing Sheets

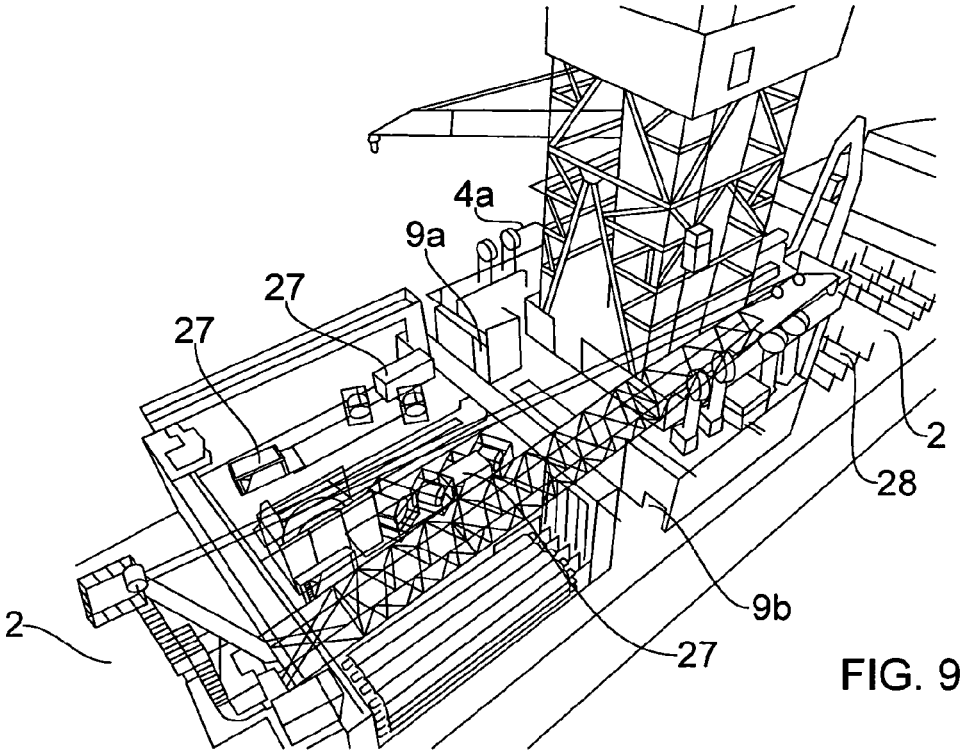
FIG. 9
FIG. 10
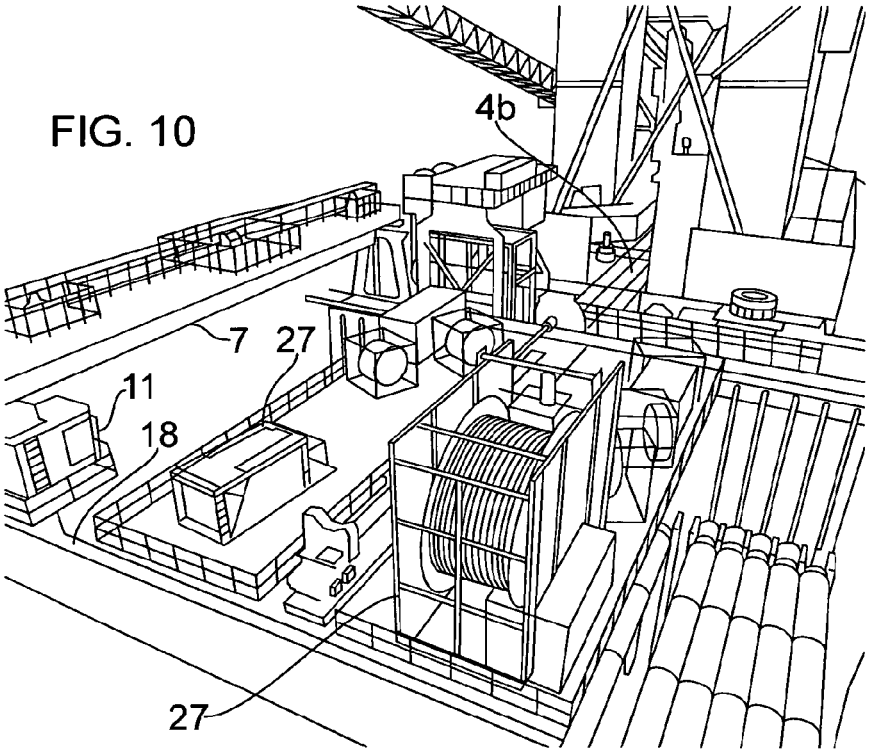

DECK ARRANGEMENT ON A VESSEL OR PLATFORM FOR PERFORMING SUBSEA OPERATIONS

FIELD OF THE INVENTION

The invention concerns a vessel or platform for performing subsea operations. More specifically, the invention relates to a deck arrangement as specified in the preamble of the independent claim 1.

BACKGROUND OF THE INVENTION

Drill ships and semi-submersible drilling rigs are often used for subsea well intervention operations. The deck layout on the known vessels serving such multiple functions is primarily designed for drilling operations, while less attention has been given to optimizing equipment handling related to well intervention work.

An example of a prior art multi-purpose (drilling, well intervention) ship is illustrated in FIG. 1 (partly shown). The ship 1 has a drilling module 4*a* comprising a drilling derrick 3 placed on a drill floor 4*b* above a moon pool (not shown). The ship also comprises a blow-out preventer (BOP) 9*a*, a BOP deck 9*b*, and a riser storage compartment 6 for holding a number of risers 5. A riser crane 7 with an operator's cabin 11 hoists the individual riser up from the riser storage compartment, where they are stored horizontally, and positions it on the riser transporter 12, which transports the riser into the derrick and upends the riser on the drill floor. A pipe deck 28 is arranged forward of the drilling module.

In a normal mode of operation, intervention equipment (not shown) is placed on the main deck 2, from where it is lifted up and onto the elevated drill floor 4*b* by the deck crane 8 as and when this equipment is being used for subsea well intervention. Equipment has to be transported into the drill floor or surrounding area from the main deck in a time consuming, piece-by-piece basis, and much of the rigging for these operations requires operations in well-centre (online) to be stopped.

The present applicant has devised and embodied this invention in order to overcome shortcomings of the prior art, and to obtain further advantages.

SUMMARY OF THE INVENTION

The invention is set forth and characterized in the main claim, while the dependent claims describe other characteristics of the invention.

It is thus provided a deck arrangement for a vessel or platform configured for performing subsea operations, the vessel or platform having a main deck and a working station and facilities for supporting activities in the working station, the working station further comprising a working area, characterized in that one or more deck elements are arranged at an elevation different from than of the main deck and at an elevation where upper surfaces of the deck elements and the upper surface of the working area are on the same, or substantially same, level.

In one embodiment, the deck elements are arranged above the main deck and above one or more of the facilities. The deck elements comprise in one embodiment motive means arranged for movably supporting the respective deck element on corresponding supports.

In one embodiment, the deck elements comprise first and second deck elements arranged above a first facility, and wherein the combined surface area of the first and second deck elements is less than the opening of the first facility.

In one embodiment, the deck elements comprise a third deck element arranged above a second facility, and wherein the surface area of the third deck element is less than the opening above the second facility.

The deck elements are individually movable and comprise propulsion means adapted and arranged for interaction with the supports on the vessel or platform.

In one embodiment, the propulsion means comprises a wheel assembly having a driver wheel connected to the propulsion means and being rotatably connected to a first wheel and a second wheel which are spaced apart and configured for interaction with the supports.

In one embodiment, the working area comprises a drill floor, the first facility comprises a riser storage compartment, and the second facility comprises a BOP deck. In one embodiment, a third facility comprises a pipe deck.

The propulsion means may also comprise a winch-and-cable arrangement, or similar, for moving the deck elements back and forth.

The invented deck arrangement enables accommodation of well intervention and workover equipment and service deck area close to the drill floor. This enables (offline) preparation of the entire well intervention and workover package, such as coiled tubing or wireline equipment; while other operations in well centre are ongoing (online).

With the invention, the available deck area is increased, and accessibility to the drill floor made easier. Well intervention and workover/service can be performed using the equipment standing on the decks according to the invention, with no need for moving this equipment. The invention provides for a more flexible multi-purpose vessel than the vessels of the prior art, saving operational time and costs. This significantly extends the operational window of the vessel, as there is no need for hoisting equipment using platform cranes (The use of platform cranes might be limited by the response movements of the vessel). The invented decks may be retrofitted to existing vessels.

BRIEF DESCRIPTION OF THE DRAWINGS

These and other characteristics of the invention will be clear from the following description of a preferential form of embodiment, given as a non-restrictive example, with reference to the attached drawings wherein:

FIGS. 9 and 10 are perspective views of a part of a combined drill ship and well intervention ship, illustrating the deck arrangement according to the invention in a second position and carrying equipment units.

DETAILED DESCRIPTION OF A PREFERENTIAL EMBODIMENT

Figure 1:
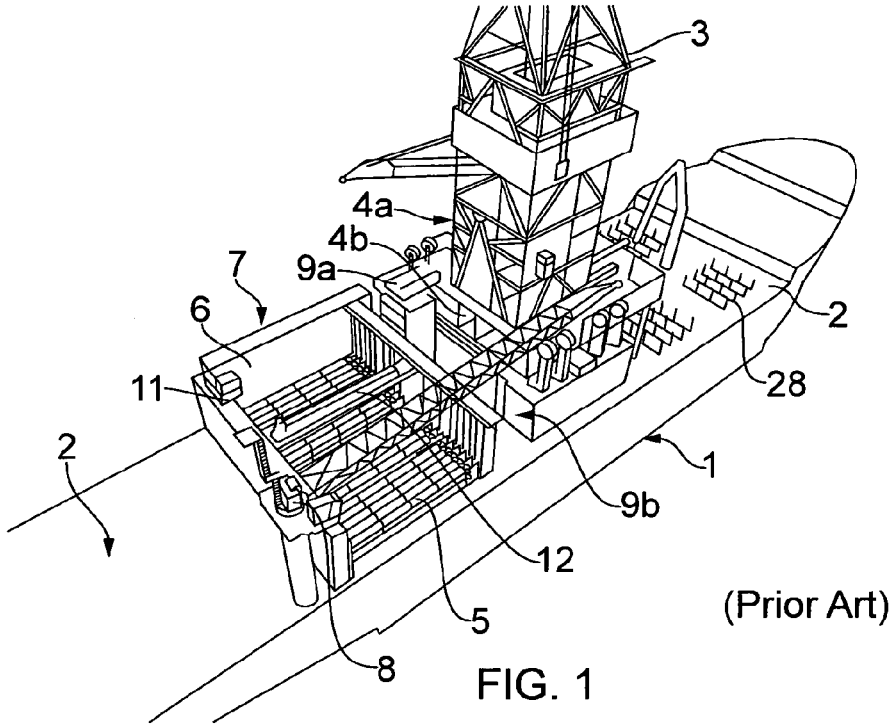
FIG. 1 is a perspective view of a part of a combined drill ship and well intervention ship, illustrating a deck arrangement according to the prior art.
Figure 2:
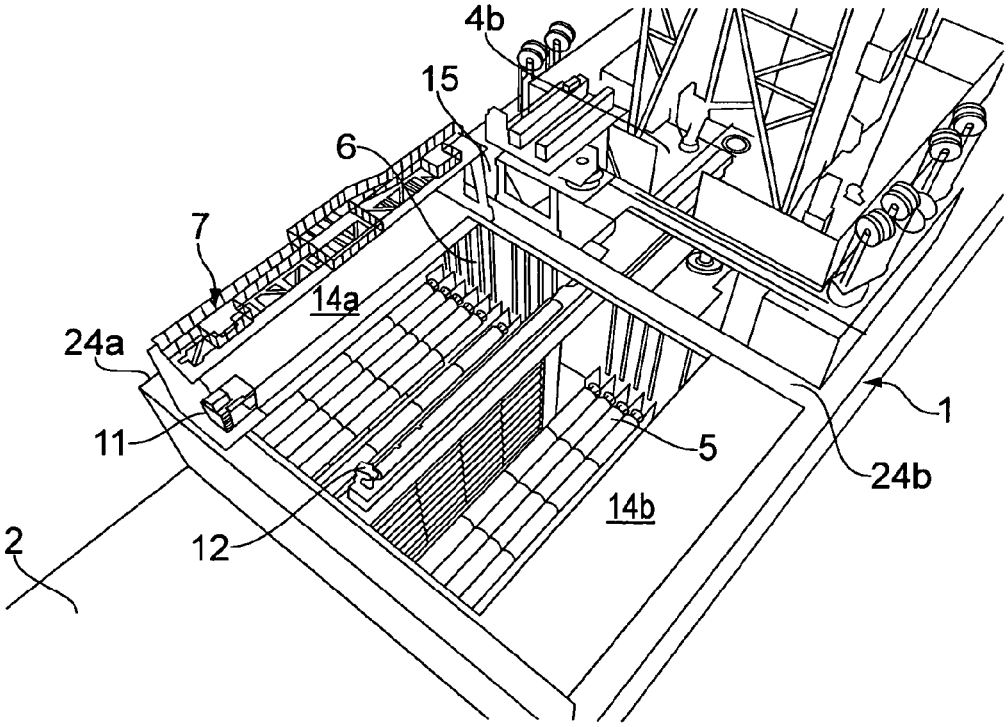
FIG. 2 is a perspective view of a part of a combined drill ship and well intervention ship, illustrating an embodiment of the deck arrangement according to the invention, in a first position.
Figure 3:
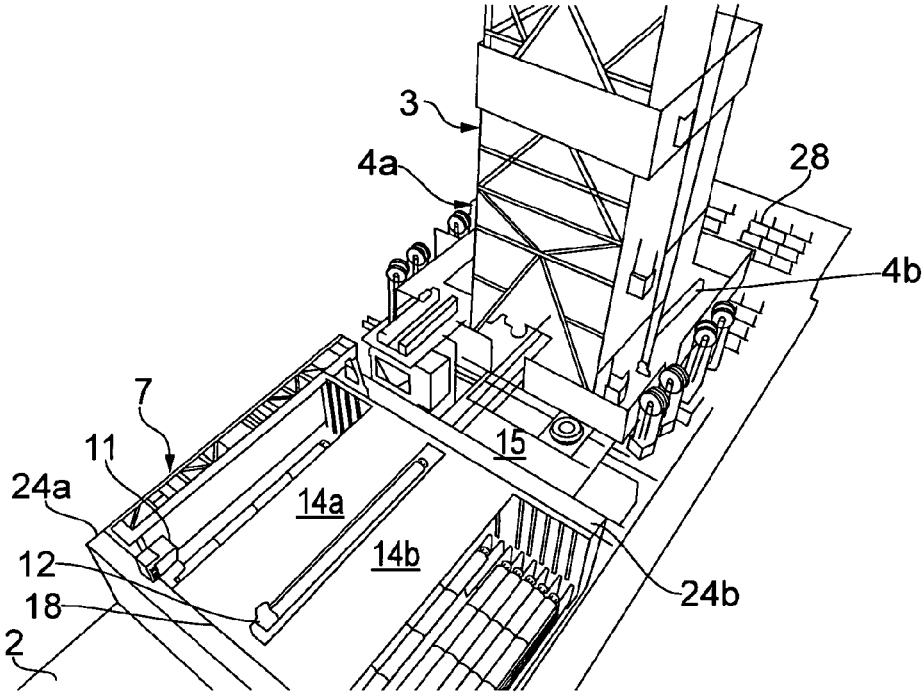
FIG. 3 is a perspective view of a part of a combined drill ship and well intervention ship, illustrating the embodiment of the deck arrangement in a second position.

Referring initially to FIG. 2 and FIG. 3, a pair of first and second deck plates 14*a*, 14*b* is arranged above the riser storage compartment 6 and a third deck plate 15 is arranged above the BOP deck 9*b*. The deck plates are arranged such that the decks' upper surfaces are flush with each other and with the drill floor 4*b*. The deck plates and the drill floor are at the same elevation. The skilled person will understand that although they are referred to as deck plates, operational load bearing requirements dictate that they in fact are designed with sufficient strength and stiffness in order to support the equipment units which they are intended to carry.

Figure 6:
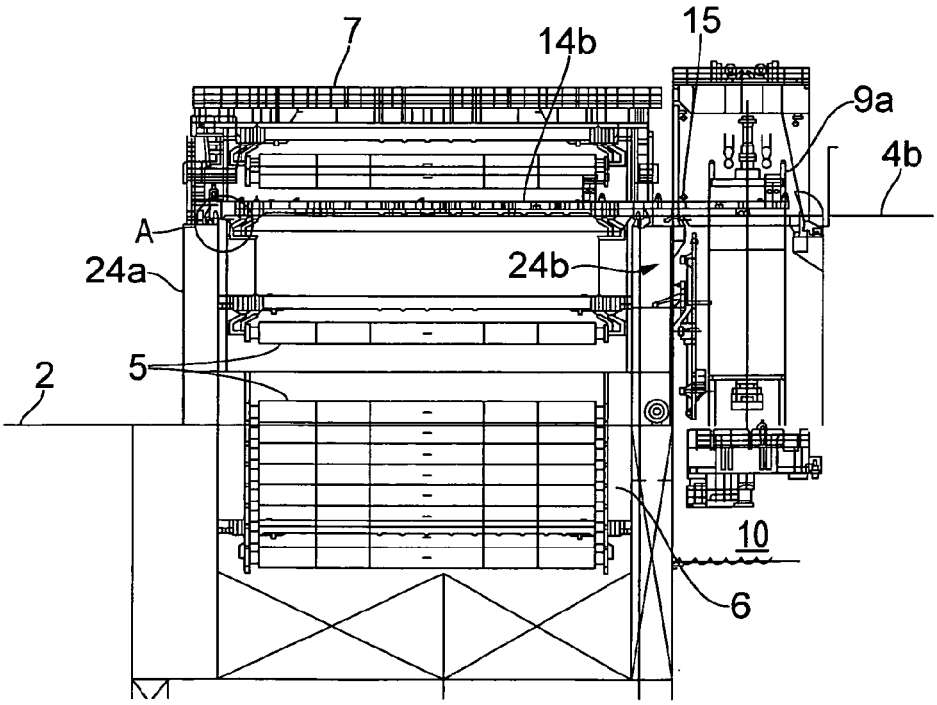
FIG. 6 is a side view of a part of a combined drill ship and well intervention ship, illustrating an embodiment of the deck arrangement according to the invention.
Figure 7:
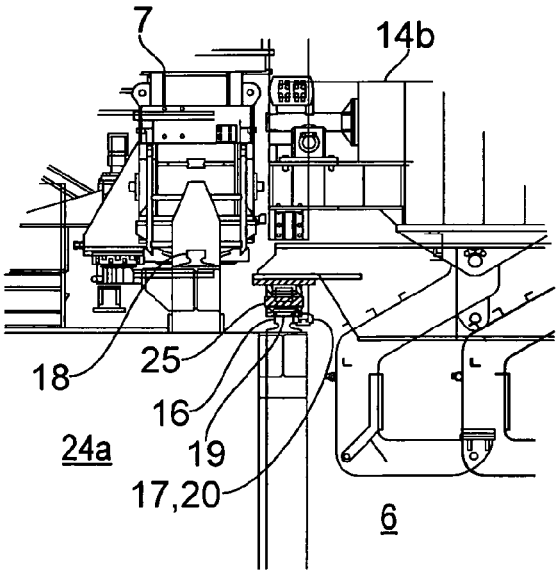
FIG. 7 is an enlargement of the region "A" in FIG. 6.

Referring additionally to FIG. 6, the first and second deck plates 14*a,b* straddle the riser storage compartment and are supported on top of the wall structures 24*a,b* defining the riser storage compartment 6. The third deck plate 15 straddle the BOP bay (and the moon pool 10) and is supported on the wall structure 24*b* separating the riser storage compartment and the BOP deck, and on structural elements adjacent to the drill floor. The deck plates are supported by rails 16, such that each deck plate is movable back and forth on these rails. This arrangement is illustrated on FIG. 7, identifying the rail 16 on top of the wall structure 24*a*, a wheel 19 rotatably connected to the deck plate and configured for rolling on the rail 16. Although not shown in the drawing, each deck plate has a number of wheels, arranged in a manner which is known in the art. A propulsion unit 17, e.g. a hydraulic motor, on the deck plate provides power to a cog wheel assembly 20 which engages with a pitch rack 25 attached to the rail. Thus, each deck plate 14*a,b*, 15 are movable back and forth on the support rails 16 by means of a rack-and-pinion configuration. Alternative motion means are conceivable, e.g. a winch-and-cable arrangement.

Figure 4:
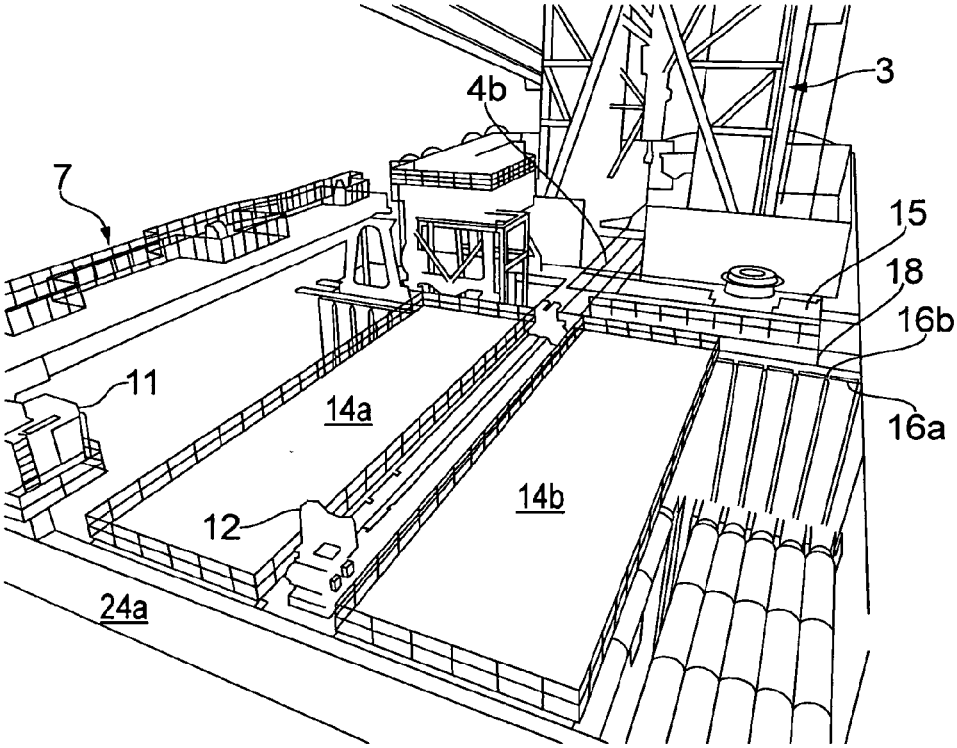
FIG. 4 is a perspective view, illustrating the deck arrangement in the second position.

The first and second deck plate 14*a,b* are preferably each designed with such area that they do not block access to the riser storage compartment, i.e. the total area is less than the upward opening of the riser storage compartment. FIG. 2 illustrates the deck plates in a first position, giving access to the central part of the riser compartment, while FIGS. 3 and 4 illustrate the deck plates in a second position, giving access to the outer parts of the riser compartment. In this second position, the plates 14*a,b*, are moved up against the riser transporter 12.

The movement of the riser crane 7 back and forth across the riser compartment does not interfere with the movement of the deck plates 14*a,b*; and vice versa. The riser crane support rails 18 are indicated on e.g. FIGS. 2 and 7. The movable decks 14*a,b*, 15 are conveniently controlled by the operator in the riser crane cabin 11.

The third movable deck plate 15 is also movable back and forth in the same manner as for the first and second deck plates, and can thus be moved in order to accommodate handling of the BOP.

FIGS. 9 and 10 illustrate how the movable deck plates are used as storage area for various intervention equipment units 27, from where the equipment units may be rolled or skidded onto the drill floor 4*b*.

Figure 5:
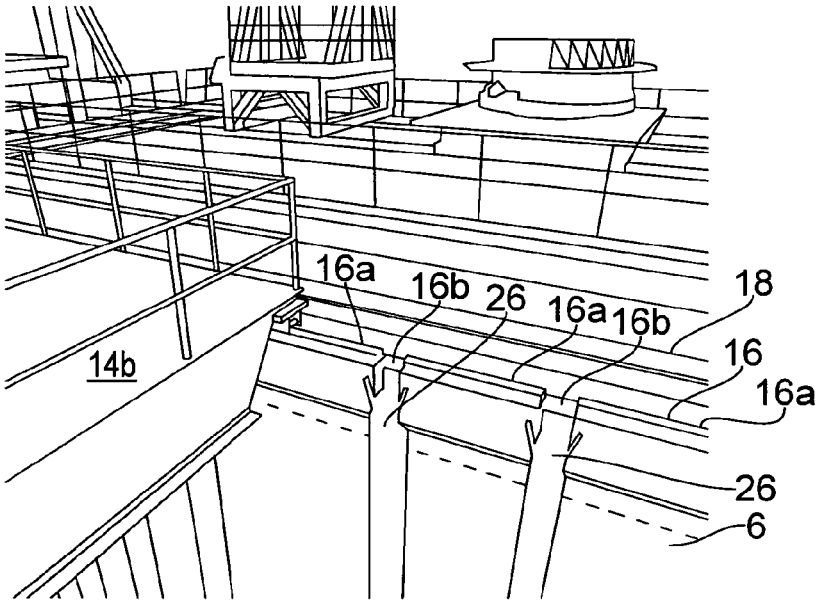
FIG. 5 is a perspective view of a part of the deck arrangement and riser storage area.
Figure 8A:
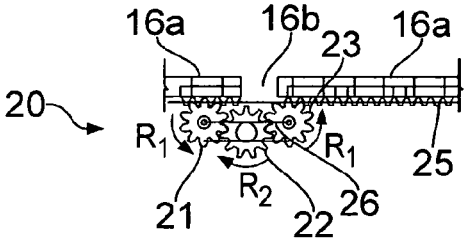
FIGS. 8*a-c* are schematic plan views of an embodiment of a rack-and-pinion drive unit according to the invention.
Figure 8B:
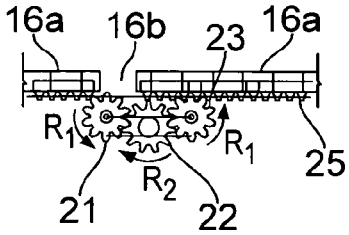
Figure 8C:
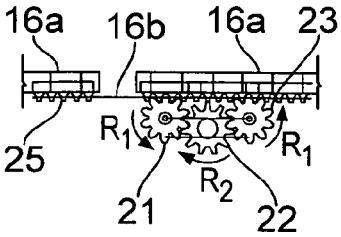

The above mentioned rack-and-pinion configuration will now be described in more detail, with reference to FIGS. 8*a-c*, which are schematic plan views showing the cog wheel assembly 20 in three positions along the rail 16 and pitch rack 25, and to the perspective view of FIG. 5.

When the risers are hoisted up from horizontal storage in the riser compartment 6, the riser ends are guided by respective guide grooves 26. Therefore, in order not to impede the riser movement, the deck plate support rails 16 comprise individual rails pieces 16*a*, separated by gaps 16*b*, each of which corresponding to the width of the groove 26. In order to ensure that the deck plate is continually movable event across the gaps 16*b*, the cog wheel assembly 20 comprises a first cog wheel 21 and a second cog wheel 23, both rotatably arranged on a frame (illustrated schematically at 26) which is connected to the deck plate. The first and second cog wheels 21, 23 are arranged with a spacing which is greater than the width of the gap 16*b*, hence enabling the assembly 20 to straddle the gap 16*b*. A driver cog wheel 22, which is drivingly connected to the propulsion unit 17 (shown in FIG. 7), is rotatably connected to the first and second cog wheels 21, 23. The arrow $R_2$ indicates the rotation of the driver wheel 22, while arrows marked $R_1$ indicate the rotation of the first and second wheels. Thus, rotation of the first and second wheels 21, 23 is synchronized by the rotation of the driver wheel 22.

Although not illustrated, it should be understood that a similar inventive deck arrangement as described above, may be arranged above the pipe deck 28, i.e. forward of the drilling module.

The invention claimed is:

1. An offshore vessel or platform configured for performing subsea operations and having a main deck, a drilling module with a drill floor, and at least one of either a BOP deck, a riser storage compartment or a pipe deck, and one or more deck plates, wherein said one or more deck plates are arranged at an elevation above the main deck and at an elevation where upper surfaces of each of said one or more deck plates and the upper surface of the drill floor are on the same, or substantially same, level, and said one or more deck plates straddle above one or more of either the BOP deck, the riser storage compartment or the pipe deck, and each of said one or more deck plates comprises a motive mechanism arranged for movably supporting the respective deck plate in a horizontal plane on corresponding supports, said one or more deck plates being arranged to be moved horizontally on the corresponding support thereby providing access to the BOP deck, the riser storage compartment or the pipe deck.

2. The offshore vessel or platform of claim 1, wherein said one or more deck plates comprise first and second deck elements arranged above a riser storage compartment, and wherein the combined surface area of the first and second deck elements is less than an opening of the riser storage compartment.

3. The offshore vessel or platform of claim 2, wherein said one or more deck plates comprise a third deck element arranged above a BOP deck, and wherein the surface area of the third deck element is less than an opening above the BOP deck.

4. The offshore vessel or platform of claim 3, wherein said one or more deck plates are individually movable.

5. The offshore vessel or platform of claim 3, wherein said one or more deck plates comprise propulsion device adapted and arranged for interaction with the supports on the vessel or platform.

6. The offshore vessel or platform of claim 3, wherein a propulsion device comprises a wheel assembly having a driver wheel connected to the propulsion device and being rotatably connected to a first wheel and a second wheel which are spaced apart and configured for interaction with the supports.

7. The offshore vessel or platform of claim 2, wherein said one or more deck plates comprise a third deck element arranged above a BOP deck, and wherein the surface area of the third deck element is less than an opening above the BOP deck.

8. The offshore vessel or platform of claim 2, wherein said one or more deck plates are individually movable.

9. The offshore vessel or platform of claim 2, wherein said one or more deck plates comprise propulsion device adapted and arranged for interaction with the supports on the vessel or platform.

10. The offshore vessel or platform of claim 2, wherein a propulsion device comprises a wheel assembly having a driver wheel connected to the propulsion device and being rotatably connected to a first wheel and a second wheel which are spaced apart and configured for interaction with the supports.

11. The offshore vessel or platform of claim 1, wherein said one or more deck plates are individually movable.

12. The offshore vessel or platform of claim 11, wherein said one or more deck plates comprise propulsion device adapted and arranged for interaction with the supports on the vessel or platform.

13. The offshore vessel or platform of claim 11, wherein a propulsion device comprises a wheel assembly having a driver wheel connected to the propulsion device and being rotatably connected to a first wheel and a second wheel which are spaced apart and configured for interaction with the supports.

14. The offshore vessel or platform of claim 1, wherein said one or more deck plates comprise a propulsion device adapted and arranged for interaction with the supports on the vessel or platform.

15. The offshore vessel or platform of claim 14, wherein the propulsion device comprises a wheel assembly having a driver wheel connected to the propulsion device and being rotatably connected to a first wheel and a second wheel which are spaced apart and configured for interaction with the supports.

16. The offshore vessel or platform of claim 1, wherein a propulsion device comprises a wheel assembly having a driver wheel connected to the propulsion device and being rotatably connected to a first wheel and a second wheel which are spaced apart and configured for interaction with the supports.

* * * * *